US012221748B2

(12) United States Patent
Sealey, II et al.

(10) Patent No.: US 12,221,748 B2
(45) Date of Patent: Feb. 11, 2025

(54) SYSTEM AND METHOD FOR CLEANING OF BELTS AND/OR FABRICS USED ON THROUGH AIR DRYING PAPERMAKING MACHINES

(71) Applicant: First Quality Tissue, LLC, Great Neck, NY (US)

(72) Inventors: James E. Sealey, II, Belton, SC (US); Marc Paul Begin, Simpsonville, SC (US); Theodore D. Kennedy, San Mateo, FL (US)

(73) Assignee: First Quality Tissue, LLC, Great Neck, NY (US)

( * ) Notice: Subject to any disclaimer, the term of this patent is extended or adjusted under 35 U.S.C. 154(b) by 0 days.

(21) Appl. No.: 17/677,170

(22) Filed: Feb. 22, 2022

(65) Prior Publication Data

US 2022/0389654 A1 Dec. 8, 2022

Related U.S. Application Data

(60) Provisional application No. 63/151,881, filed on Feb. 22, 2021.

(51) Int. Cl.
*D21F 1/32* (2006.01)

(52) U.S. Cl.
CPC ..... *D21F 1/32* (2013.01)

(58) Field of Classification Search
CPC ..... D21F 1/32; D21F 1/00; D21F 7/08; D21F 1/0027; B29B 17/02; B29B 17/0412
See application file for complete search history.

(56) References Cited

U.S. PATENT DOCUMENTS

| | | | |
|---|---|---|---|
| 3,143,150 | A | 8/1964 | Buchanan |
| 3,473,576 | A | 10/1969 | Amneus |
| 3,573,164 | A | 3/1971 | Friedberg et al. |
| 3,905,863 | A | 9/1975 | Ayers |
| 3,974,025 | A | 8/1976 | Ayers |
| 3,994,771 | A | 11/1976 | Morgan, Jr. et al. |
| 4,102,737 | A | 7/1978 | Morton |
| 4,184,519 | A | 1/1980 | McDonald et al. |
| 4,191,609 | A | 3/1980 | Trokhan |
| 4,514,345 | A | 4/1985 | Johnson et al. |

(Continued)

FOREIGN PATENT DOCUMENTS

| | | | |
|---|---|---|---|
| EP | 1339915 | B1 | 7/2007 |
| WO | 2020106193 | A1 | 5/2020 |
| WO | 2021141586 | A1 | 7/2021 |

OTHER PUBLICATIONS

International Search Report and Written Opinion Issued to PCT/US2022/017226, dated May 2, 2022.

(Continued)

*Primary Examiner* — Jacob T Minskey
*Assistant Examiner* — Matthew M Eslami
(74) *Attorney, Agent, or Firm* — Amster, Rothstein & Ebenstein LLP

(57) ABSTRACT

A method for cleaning a belt of a through air drying papermaking machine in which a high pressure shower is configured to traverse across a width of the belt of the papermaking machine while ejecting water onto the belt, and a vacuum box is operatively connected to the high pressure shower. The high pressure shower has a width that is less than a full width of the belt.

21 Claims, 7 Drawing Sheets

(56) References Cited

U.S. PATENT DOCUMENTS

| | | | | |
|---|---|---|---|---|
| 4,528,239 | A | 7/1985 | Trokhan | |
| 4,529,480 | A | 7/1985 | Trokhan | |
| 4,637,859 | A | 1/1987 | Trokhan | |
| 4,909,284 | A | 3/1990 | Kositzke | |
| 5,334,289 | A | 8/1994 | Trokhan et al. | |
| 5,510,002 | A | 4/1996 | Hermans et al. | |
| 5,679,222 | A | 10/1997 | Rasch et al. | |
| 5,783,044 | A * | 7/1998 | Schneider | D21F 1/325 162/278 |
| 5,806,569 | A | 9/1998 | Gulya et al. | |
| 6,135,267 | A | 10/2000 | Straub | |
| 6,364,959 | B1 | 4/2002 | Straub et al. | |
| 6,610,173 | B1 | 8/2003 | Lindsay et al. | |
| 6,660,362 | B1 | 12/2003 | Lindsat et al. | |
| 6,998,017 | B2 | 2/2006 | Lindsay et al. | |
| 2001/0013399 | A1 * | 8/2001 | Scherb | D21F 9/003 162/336 |
| 2021/0214892 | A1 * | 7/2021 | Dawson | D21F 5/182 |

OTHER PUBLICATIONS

Multi-Compartment Suction Box Brochure, Doctoring, Cleaning, Filtration, Kadant Solutions Division, Kadant, (2019).

* cited by examiner

SYSTEM AND METHOD FOR CLEANING OF BELTS AND/OR FABRICS USED ON THROUGH AIR DRYING PAPERMAKING MACHINES

TECHNICAL FIELD

This invention relates to systems and methods for cleaning belts and/or fabrics of papermaking machines, and in particular is related to systems and methods for cleaning belts of through-air-drying papermaking machines.

BACKGROUND

The through air drying (TAD) process is a method for making a tissue paper web (sheet). The major steps of the through air drying process are stock preparation, forming, imprinting, thermal pre-drying, drying, creping, calendering (optional), and reeling the web. In stock preparation, the proper recipe of fibers, chemical polymers, and additives (specific for the grade of tissue paper being produced) are mixed, diluted in a slurry, and delivered to the forming section of the paper machine.

In the forming section, the slurry is deposited out of the machine headbox (single, double, or triple layered) to the forming surface in order to provide an even distribution of fibers and a uniform nascent paper web. Water is drained from the web in the forming section through permeable forming fabrics before transfer to a structuring fabric. Forming fabrics are woven structures that utilize monofilaments (such as yarns or threads) composed of synthetic polymers (usually polyethylene, polypropylene, or nylon). Examples of forming fabrics designs can be viewed in U.S. Pat. Nos. 3,143,150; 4,184,519; 4,909,284; and 5,806,569.

After the forming step, the nascent web is pulled into the structuring fabric using vacuum to impart the weave pattern of the structuring fabric into the nascent paper web. This process is referred to as "imprinting". The manufacturing method of a structuring fabric is similar to that of a forming fabric (see, for example, U.S. Pat. Nos. 3,473,576; 3,573,164; 3,905,863; 3,974,025; and 4,191,609) except for the addition of an overlaid polymer. Structuring fabrics with an overlaid polymer are disclosed in U.S. Pat. Nos. 5,679,222; 4,514,345; 5,334,289; 4,528,239; 4,637,859; 6,610,173; 6,660,362; 6,998,017; and European Patent No. EP 1 339 915.

After imprinting, the nascent web is thermally pre-dried by moving hot air through the web on TAD drums while the web is conveyed on the structured fabric. Thermal pre-drying can be used to dry the web to over 90% solids before it is transferred to a steam heated cylinder though a very low intensity nip between a solid pressure roll and the steam heated cylinder. The steam cylinder, and an optional air cap system for impinging hot air, then dry the web to up to 99% solids during the drying stage before creping occurs. After creping, the web is optionally calendered and reeled into a parent roll. The web is then ready for the converting process.

Many TAD machines utilize a nip between a fabric and a building parent roll, rather than a nip between a machine roll or reel and the building parent roll, to provide a larger and lower pressure nip for improved productivity and quality. This fabric is referred to as the reel belt. The reel belt also supports the web as it is conveyed from the calendars to the parent roll to reduce tension in the web that can lead to sheet breaks.

The following patents describe creped through air dried products: U.S. Pat. Nos. 3,994,771, 4,102,737, 4,529,480, and 5,510,002.

Cleaning of fabrics utilized on "through air drying" paper machines is important in controlling machine productivity and paper quality. As the fabrics on TAD machines either drain, imprint, or convey the paper web, they can become contaminated with components of the slurry used to make the paper web, such as fibers and chemistry. Contamination can lead to lost productivity or poor product quality. For example, when a structuring fabric on a "through air drying" paper machine is contaminated, the ability for air to flow through the web, structuring fabric and into the TAD drum is restricted. If the air flow is restricted, the web will not dry quickly and the machine will need to be slowed to increase dwell time across the TAD drum to enhance drying. Slowing of the machine will lead to lost productivity.

Oftentimes, a structuring fabric can be contaminated unevenly. This will lead to uneven web drying across the TAD drum. Differences in web moisture directly affect the quality parameters of the web, leading to variable web properties and poor quality.

As a further example, a contaminated reel belt can entrap air between the reel belt and paper web, leading to loss in web stability, which in turn leads to web breaks and thus lost productivity.

Conventional methods for cleaning the fabrics on through air drying tissue and towel machines often include the application of so-called flooding showers and impact showers. Flooding showers apply a relatively high volume (approximately 3,300 liters per minute), low velocity water jet across the entire width of the inner (non-sheet contacting) side of a looped fabric to loosen and remove contaminants from the body or interstices of the fabric. Impact showers apply a relatively high velocity, low volume (approximately 1,500 liters per minute) water jet to the entire width of a fabric to clean contaminants off the outer (sheet contacting) surface of the fabric. The two showers are often used together to provide optimal cleaning to both sides of a fabric. For example, the impact shower first ejects a high velocity water jet to the outer surface of the fabric to dislodge the wood pulp fibers from the surface of the fabric, and then the flooding shower ejects high volume water jet to the inner surface of the fabric to flood the void space in the fabric with enough water to flush fiber from interstices of the fabric as well as the fiber on the surface of the fabric loosened by the impact shower. In most operations, the flooded nip shower is first along the papermaking machine line, followed by the impact shower. Oftentimes a third shower is used to help remove contaminants loosened by the chisel shower. This fan shower is low volume (1,500 liter per minute) and low pressure and designed to move the contaminants away from the fabric.

A vacuum box that extends across the full width of the paper machine is often utilized after showering to dry the fabric and prevent rewet of the paper web as the looped fabric returns to conveying the paper web. The vacuum box is often times on the opposite side of the TAD fabric than the high pressure shower devices. In addition to vacuum, higher pressure air can be utilized to help remove any remaining water and fiber in the fabric after showering. The apparatus for ejecting high pressure air is typically referred to as an "air knife," which includes a slotted nozzle extending in the cross-machine direction through which super-atmospheric pressure air is projected against the inner surface of the looped fabric. Utilization of the air knife through the fabric directly into the vacuum box is often optimal for removal and collection of water and fiber after showering.

Known systems and methods for cleaning fabrics on through air drying tissue machines involve the use of water, air and vacuum devices across the full paper machine width. Accordingly, such systems and methods require large volumes of water and energy, thereby diminishing the cost effectiveness (and sustainability) of the overall process

SUMMARY OF THE INVENTION

An object of the present invention is to provide a cost effective (and more resource sustainable) method to maintain belt and/or fabric hygiene in a through-air-drying tissue-making process.

The inventive method utilizes traversing higher pressure showers to clean belts and/or fabrics on a TAD machine. Belts and/or fabrics that may be cleaned using the methods according to various exemplary embodiments of the present invention include the structuring fabric and the reel belt.

A system useful for cleaning a belt and/or fabric of a through air drying papermaking machine according to an exemplary embodiment of the present invention comprises: a high pressure shower configured to traverse across a width of the belt of the papermaking machine while ejecting water onto the belt, and a vacuum box operatively connected to the high pressure shower. The high pressure shower has a width that is less than a full width of the belt.

BRIEF DESCRIPTION OF THE DRAWINGS

Exemplary embodiments of the present invention will be described with references to the accompanying figures, wherein.

DETAILED DESCRIPTION

Figure 1:
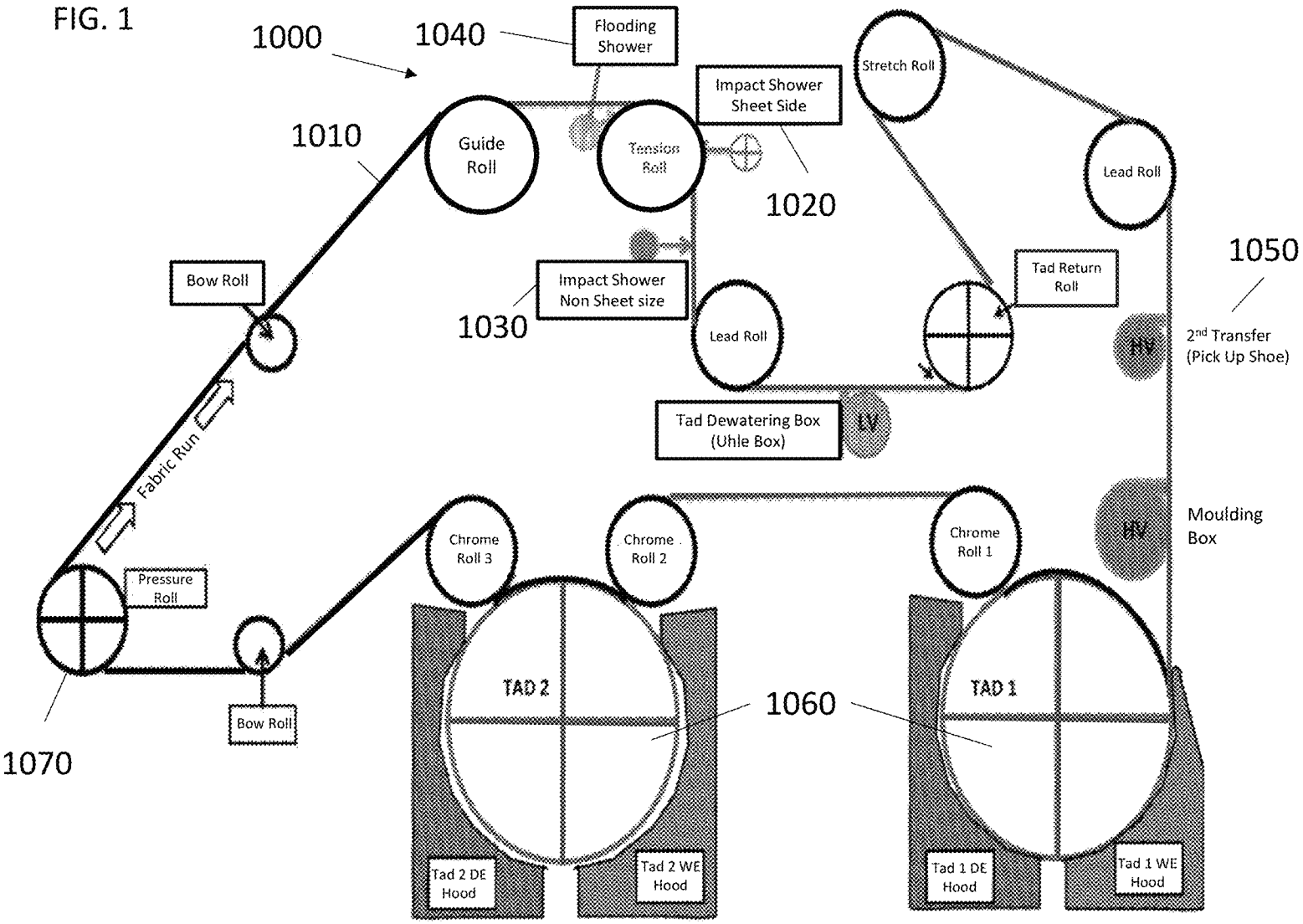
FIG. 1 is a block diagram illustrating a conventional system and method for cleaning a structuring fabric.

A high pressure shower may be used to clean the sheet-contacting side (or the roll contacting side) of a structuring fabric of a TAD machine. In accordance with exemplary embodiments of the present invention, rather than a full width impact shower, a traversing higher pressure shower is utilized. This shower can also have an attached vacuum source to immediately vacuum off the loosened contamination. The vacuuming is preferably done on the same side as the showering. One suitable machine for cleaning fabrics or belts according to exemplary embodiments of the method of the present invention is an M-clean™ available from Kadant Solutions.

Embodiments of the present invention are applicable to belts used on through-air-drying papermaking machines. It should be appreciated that the term "belt" as used herein may refer to any type of belt used on a through-air-drying papermaking machines, including but not limited to structuring fabrics and reel belts. The following terms may be used interchangeably herein: "structuring belt"; "structured belt"; "structuring fabric"; "structured fabric"; "imprinting belt"; and "imprinting fabric". These terms refer to an endless element or component with a structured or pattered surface used on a paper-machine to increase the bulk of the fibrous web by imprinting its surface pattern into the web. On tissue products the improvement in bulk can also lead to improvements in vital quality parameters such as absorbency and softness. A "reel belt" as used herein may be defined as a flexible, endless element or component used on a paper-machine to provide a nip point to a surface upon which a paper web is wound. The surface upon which the web is wound is typically referred to as a spool or shaft.

The preferred nozzle used to apply the high pressure water is a needle shower nozzle that ejects a round water jet with a diameter of from about 0.15 mm to about 0.55 mm, with a preferred diameter of 0.2 mm to 0.3 mm. The pressure of the water jet is from about 20 Bar to about 600 Bar, preferably 100 Bar to 300 Bar. The number of nozzles on the traversing head can range from 1 nozzle to 50 nozzles, more preferably 1 to 20 nozzles, and most preferably 1 to 10 nozzles. Fish tail nozzles may also be useful in exemplary embodiments of the present invention. Nozzles having spray angles of about 15 to 30 degrees, for example, 20 degrees, with openings of about 0.25 mm may be suitable. The nozzles may provide a hitting angle against the fabric of from about 20 to about 50 degrees, for example, about 40 degrees. The distance between nozzle tips and the fabric may be from about 2 mm to about 6 mm or about 3 mm to 4 mm. A range of flows may be from 2 to 20 liters per minute.

Due to the traversing nature of the shower, a controller is used to adjust the distance of the shower by one shower jet diameter per revolution of the structuring fabric for even fabric cleaning. The shower is preferably used near a roll where the fabric has a significant amount of wrap around the roll. The wrap may incorporate from about 30 to about 270 degrees around the circumference of the roll, for example between 90 to 220 degrees around the circumference of the roll, and as a further example between 110 to 180 degrees around the circumference of the roll. This fabric wrap allows for the utilization of a high efficiency vacuum box that is assisted by centripetal force to remove the loosened contamination. The optionally attached vacuum box has an inside surface composed of a ceramic material to prevent fabric wear resulting from contact with the structuring fabric. The vacuum box shape preferably matches the shape of the roll around which the fabric is wrapped to allow for intimate contact with the fabric. The box immediately removes the contamination using vacuum and is assisted by the centripetal force as the fabric moves along the circumference of the machine roll. The vacuum may provide flow of about 17 cubic meter/min at −0.3 Bar. If a flooding shower is utilized, the vacuum box may not be necessary as the loosened debris is flushed from the fabric by the flooding shower water and centripetal force around the roll. The water and vacuum piping to the high pressure shower and vacuum box is preferably flexible such that it can be compressed or folded as the shower traverses in the cross direction along the fabric.

The traversing shower and attached vacuum box can also be utilized to clean the inside (non-sheet contacting side) of the structuring fabric. A traversing higher pressure shower eliminates the need for a fixed full width impact shower which would otherwise use much more water and energy. Typically, a full width impact shower will use between 1.0 to 3.0 liter/min of water per inch width of the structuring fabric. When utilizing a traversing shower, the water use may be about 95% less than the full width impact shower, or about 0.05 to 0.15 liter/min per inch width of the structuring fabric. At 100 Bar, the water flow will be about 4.05 l/min. At 200 Bar, the water flow will be about 5.85 l/min. At 300 Bar, the water flow will be about 7.65 l/min. The energy associated with pumping water is roughly linear to the flow and thus up to 95% more energy efficient when using a traversing shower compared to the full width fixed impact shower.

In embodiments, a traversing high pressure shower and vacuum box may be used to clean the reel belts used on some TAD machines. When the paper web reaches the reel belt, the web has been fully dried; typically to about 97% consistency (3% water). Any contact with water on the reel belt or wet spot in the web would cause the web to stick to the belt and break rather than transfer from the belt and wind onto the finished paper roll, which is then converted into thousands of rolls intended for consumers in a separate process. Thus, in order to keep the reel belt clean from contaminants, full cross direction width showers cannot be utilized while the web is traveling along the belt. The conventional method to clean the fabric involves discontinuation of the paper-making process while a full width flooded nip shower is used to clean the reel belt. Once the belt has been cleaned, a full width air shower is used to dry the belt before resuming making paper.

With the inventive method, cleaning the reel belt is possible while continuing to make paper. In this regard, a traversing higher pressure needle shower along with an attached vacuum source is utilized on a roll with a high degree of wrap (i.e., there is a high degree of wrap of the reel belt around the roll) after the sheet has been transferred to the Yankee dryer while at the same time the endless looped reel belt returns to convey the paper web. This method increases productivity on the paper machine since no downtime is required to clean the reel belt.

In another exemplary embodiment, the traversing shower and vacuum header incorporates a traversing air knife. If the traversing shower is installed along a flat section of a fabric uninterrupted by a machine roll, then a traversing air knife can be placed on the same side of the fabric as that of the traversing vacuum header to aid in the removal of the applied shower water and released contaminants into the vacuum head. The width of the traversing air knife may match the width of the vacuum box and may move in synchronicity with the vacuum box through use of a positioning system.

According to an exemplary embodiment, the traversing shower and vacuum header may be used for spot cleaning of the structuring fabric or reel belt. The shower positioning system may position the shower directly over an area of the fabric or belt that has higher contamination compared to the remainder of the fabric. Once the fabric cleanliness is even, the positioning system can proceed with traversing the shower across the full width of the fabric or belt.

According to an exemplary embodiment of the present invention, a traversing high pressure shower and vacuum box is used to clean multi-layer TAD (structured tissue) fabrics. Examples of such fabrics are disclosed in U.S. Pat. Nos. 10,208,426; 10,415,185; 10,815,620; and 10,787,767, the contents of which are incorporated herein by reference in their entirety. The need to clean TAD fabrics without direct flow thru channels requires more targeted water and vacuum cleaning systems which the current invention provides. An advantage of the M-clean™ system is provided by the application of water against a turning roll or blocked back side of the fabric. This prevents the water from passing completely through the fabric which enables the vacuum system to remove the fiber/water mixture from the side the water is added. This is important to reduce the amount of fiber stapling into the inner zones of the multi-ply fabric since the "air" channels are not aligned in the Z directions and can become difficult to clean. Other types of fabrics which may benefit from the cleaning systems and methods in accordance with exemplary embodiments of the present invention include fabrics having structures as described in U.S. Pat. Nos. 10,099,425 and 10,675,810, the contents of which are also incorporated herein by reference in their entirety. These 3-D printed structures include multiple shapes and interfaces between layers which require improved cleaning that conventional methods cannot provide.

FIG. 1 is a block diagram illustrating a conventional system 1000 and method for cleaning a structuring fabric. As shown, typically a sheet side impact shower 1020 and non-sheet side impact shower 1030 are utilized with a non-sheet side flooding shower 1040. The impact showers 1020, 1030, 1040 extend across the full width of the fabric 1010. The paper web is transferred from a forming fabric to the structuring fabric at the $2^{nd}$ transfer 1050 where it is then conveyed through one or more TAD drums 1060 which blow hot air through the web for drying. The web is transferred to the Yankee dryer (not shown) at the pressure roll 1070, at which point the endless looped structuring fabric 1010 is then cleaned and returned to the $2^{nd}$ transfer to again convey the sheet through the TAD drums 1060 to the Yankee dryer.

Figure 2:
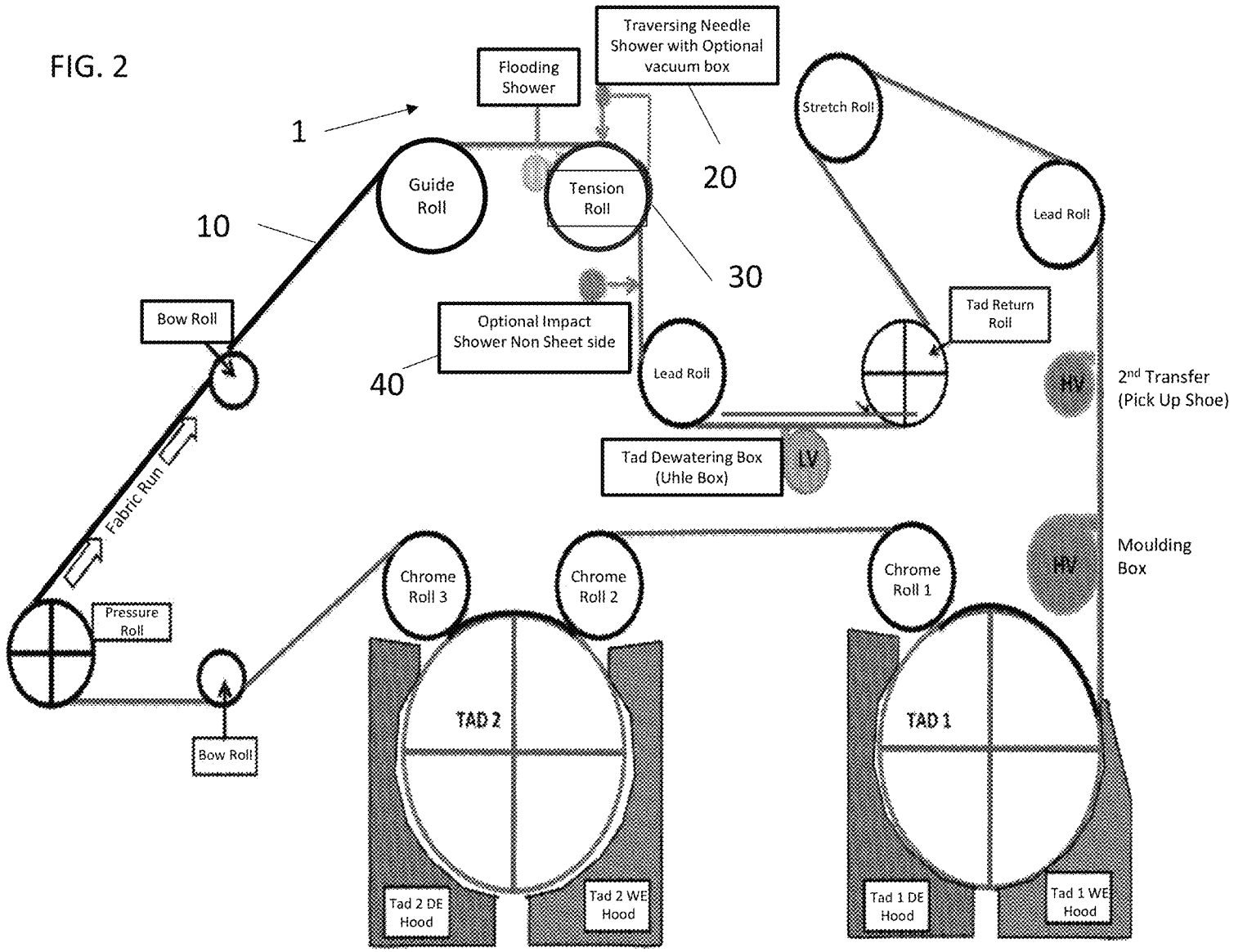
FIG. 2 is a block diagram illustrating a system and method for cleaning of a structuring fabric according to an exemplary embodiment of the present invention.

FIG. 2 is a block diagram illustrating a system 1 and method for cleaning of a structuring fabric according to an exemplary embodiment of the present invention. As shown, the sheet side full width impact shower is replaced with a traversing needle shower 20 and optional attached vacuum box 30. The water and energy requirements for the traversing shower 20 are approximately 95% less than the full width impact shower. If a flooding shower 40 that flushes from the non-sheet side to sheet side of the fabric 10 is utilized in the nip between the roll and fabric 10 upon which the traversing shower 20 is located, than an attached vacuum box to the traversing shower may be unnecessary.

Figure 3:
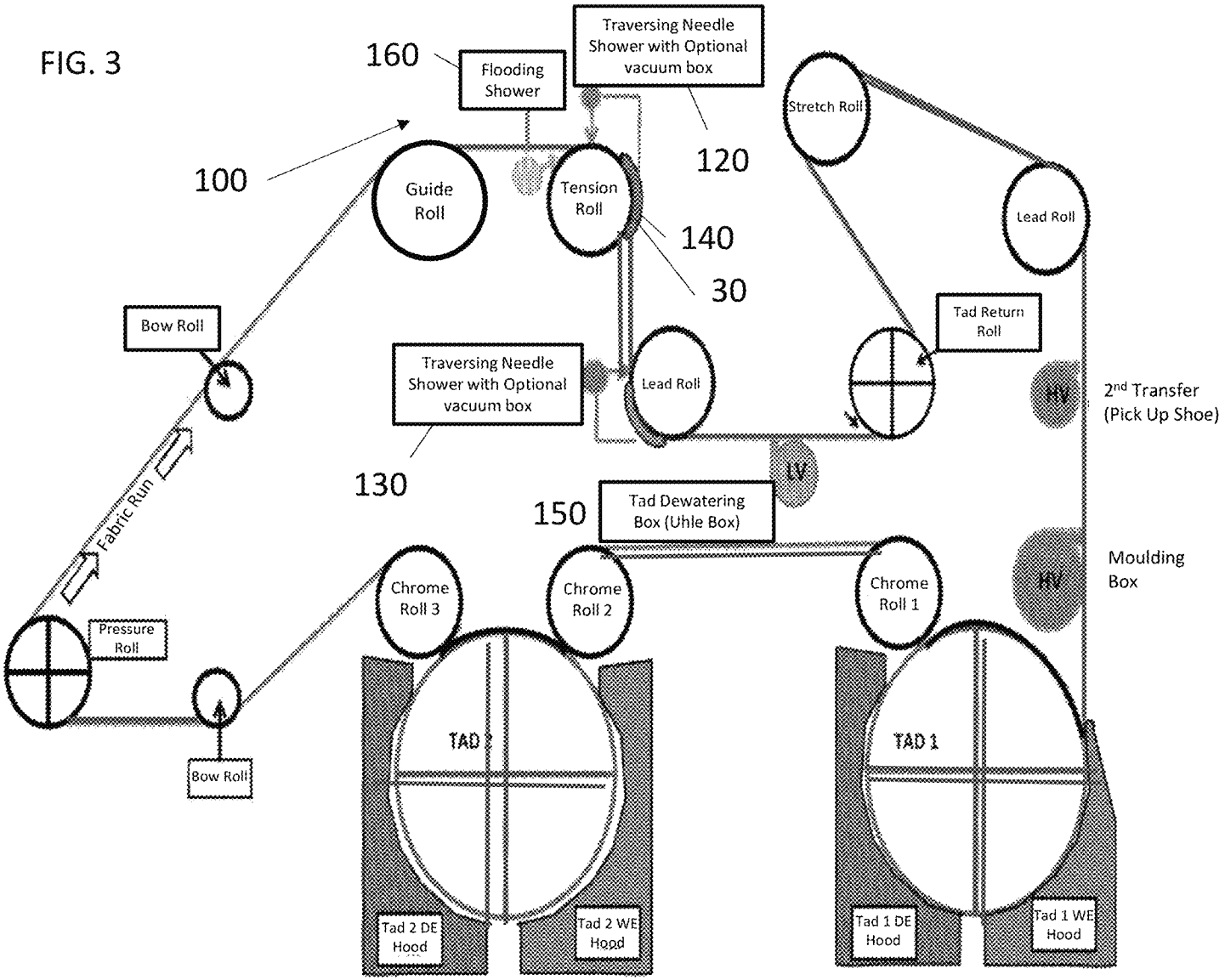
FIG. 3 is a block diagram illustrating a system and method for cleaning of a structuring fabric according to an exemplary embodiment of the present invention.

FIG. 3 is a block diagram illustrating a system 100 and method for cleaning of a structuring fabric according to an exemplary embodiment of the present invention. As shown, both the sheet side full width impact shower and the non-sheet side full width impact shower are replaced with respective traversing needle showers 120, 130 and optional vacuum boxes 140, 150. The water and energy requirements for the traversing shower 120, 130 are approximately 95% less than the full width impact shower. If a flooding shower 160 that flushes from the non-sheet side to sheet side of the fabric 110 is utilized in the nip between the roll and fabric 110 upon which the traversing shower 120, 130 is located, then an attached vacuum box to the traversing shower may be unnecessary.

Figure 4:
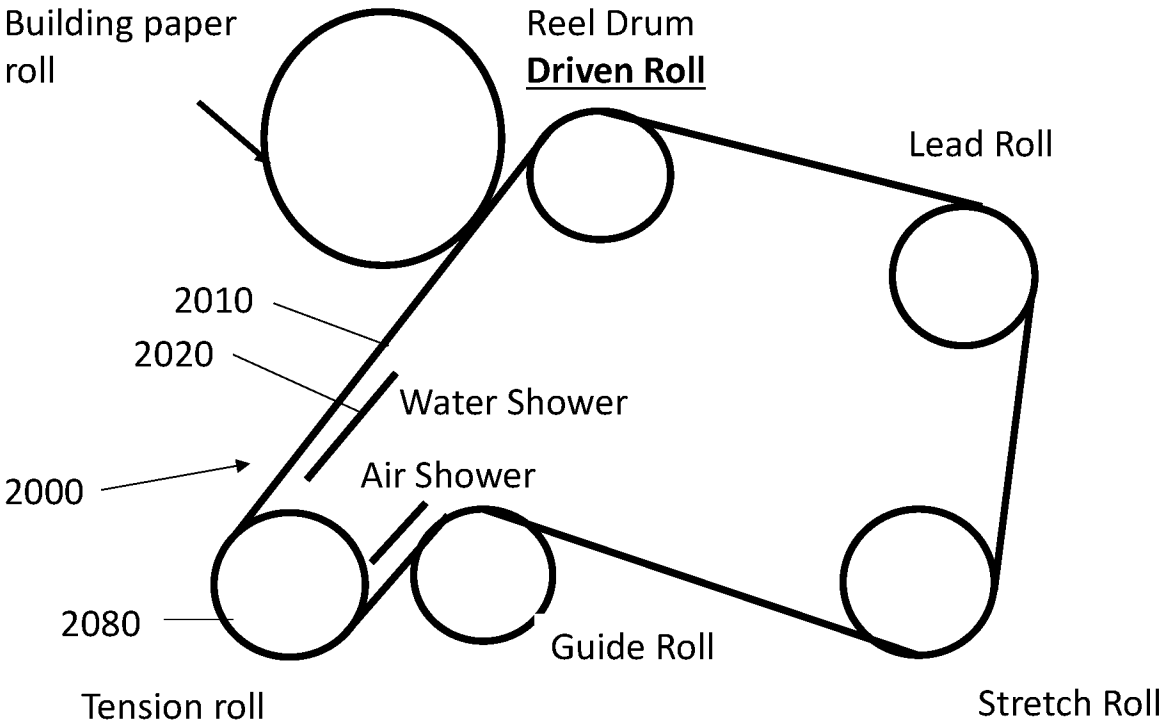
FIG. 4 is a block diagram illustrating a conventional system and method for cleaning of a reel belt.

FIG. 4 is a block diagram illustrating a conventional system 2000 and method for cleaning of a reel belt. As shown, a non-sheet side to sheet side flooding shower 2020 is used in the nip between the reel belt 2010 and a roll 2080 with a high degree of fabric wrap. The shower 2020 is operated only when the sheet/web is not being produced and thus contributes to lost productivity.

Figure 5:
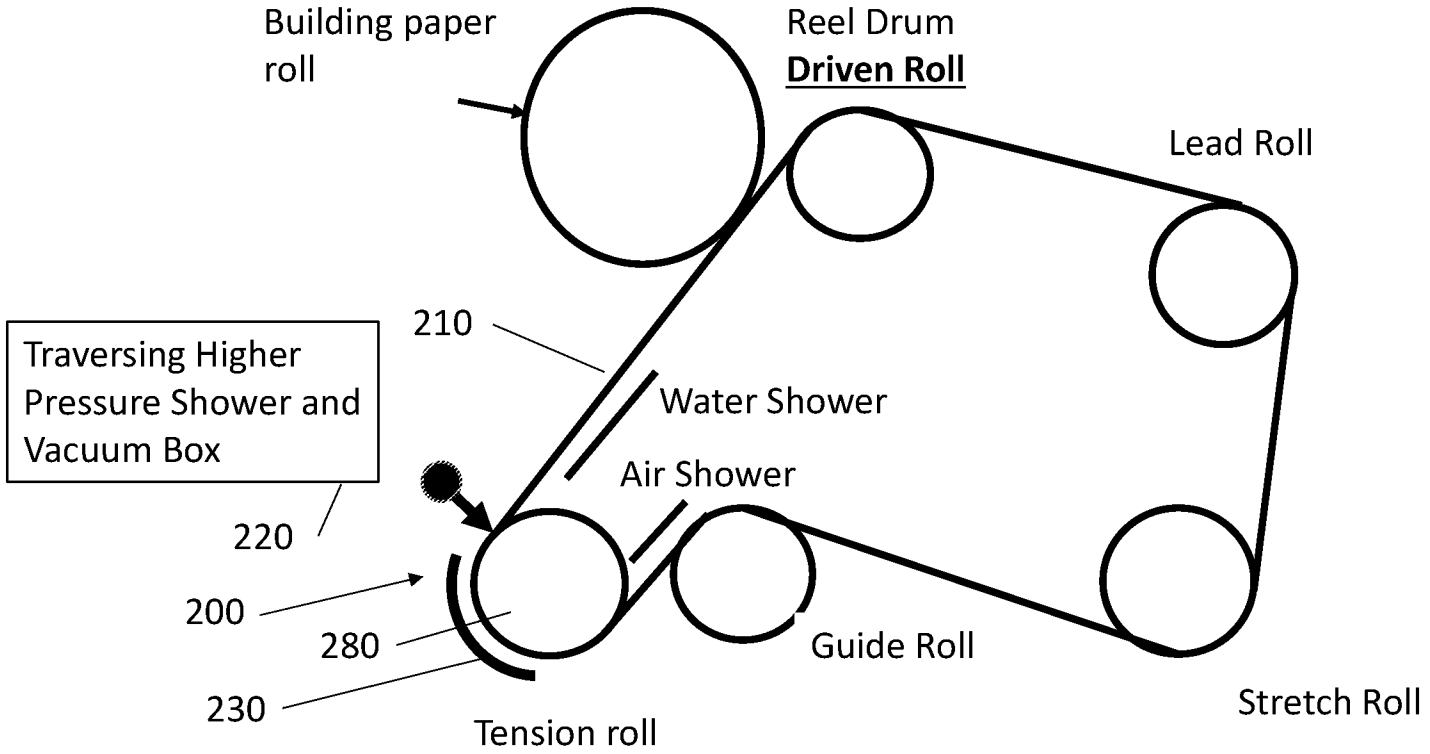
FIG. 5 is a block diagram illustrating a system and method for cleaning of a reel belt according to an exemplary embodiment of the present invention.

FIG. 5 is a block diagram illustrating a system 200 and method for cleaning of a reel belt according to an exemplary embodiment of the present invention. A shown, a traversing shower 220 and attached vacuum box 230 is used to clean the fabric 210 along a roll 280 with a high degree of fabric wrap after the sheet/web has been transferred to the building parent roll. The shower 220 can be run while the paper web is being conveyed since the vacuum box 230 is removing the contaminants and small volume of water from the traversing shower 220 with the aid of centripetal force before the reel belt 210 returns to conveying the web.

Figure 6:
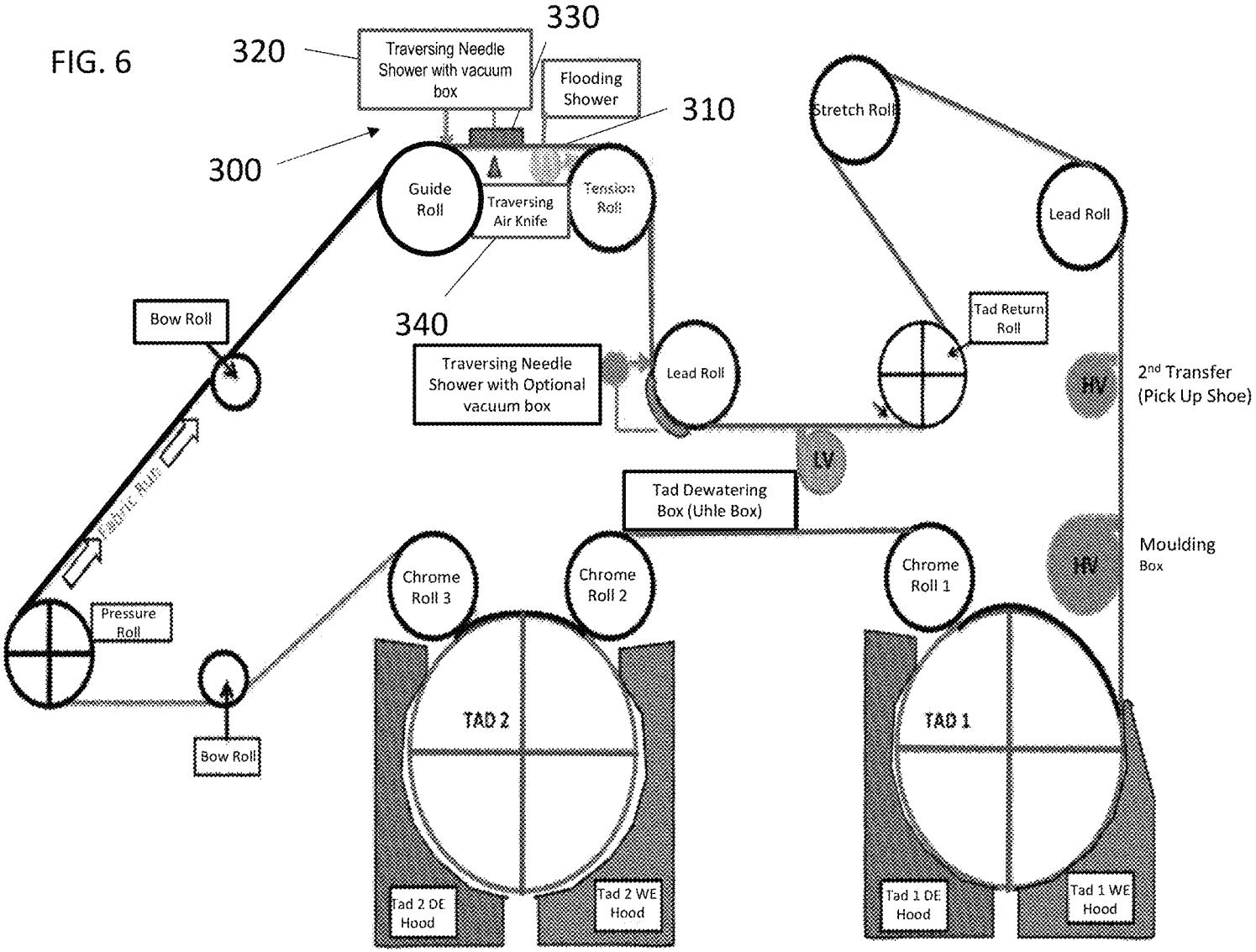
FIG. 6 is a block diagram illustrating a system and method for cleaning of a structuring fabric or reel belt with the use of a traversing air knife according to an exemplary embodiment of the present invention.

FIG. 6 is a block diagram illustrating a system 300 and method for cleaning of a structuring fabric or reel belt with the use of a traversing air knife according to an exemplary embodiment of the present invention. As shown, a traversing shower 320 and attached vacuum box 330 is used to clean the fabric 310 along a flat section of the fabric uninterrupted by a machine roll. A traversing air knife 340 can be placed on the opposing side of the fabric 310 to the traversing vacuum head 330 to aid in the removal of the applied shower water and released contaminants into the vacuum head 330.

Figure 7:
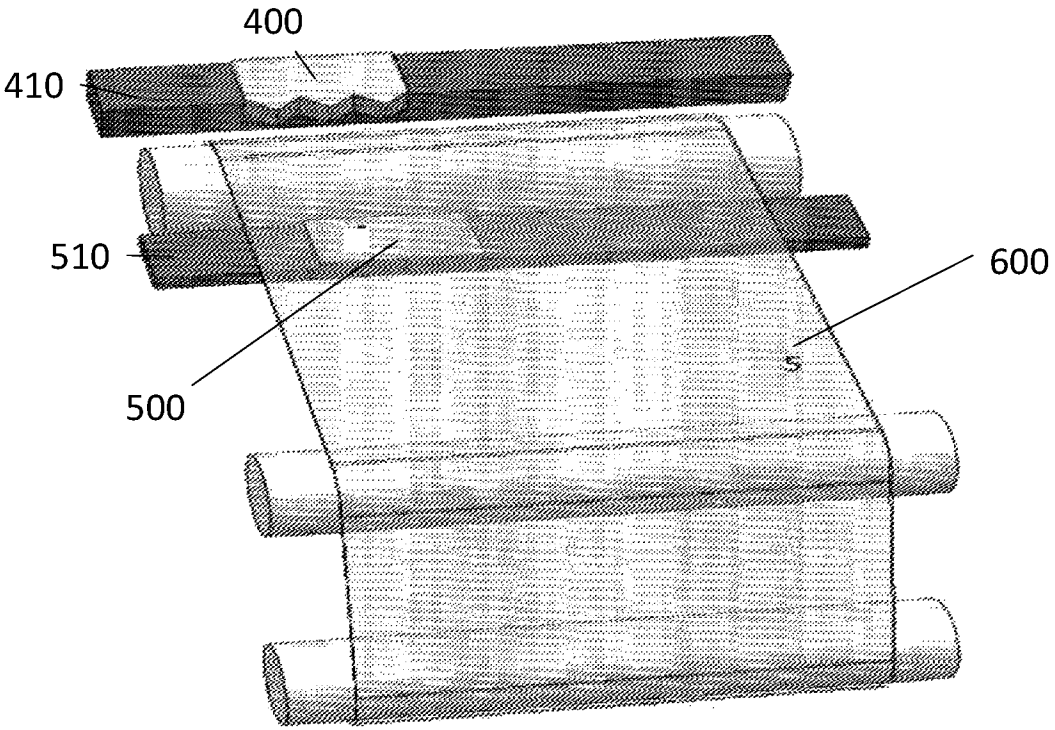
FIG. 7 is a representative drawing showing a traversing shower and vacuum box according to an exemplary embodiment of the present invention operating on a belt of a through-air-drying papermaking machine.

FIG. 7 shows a traversing shower head, generally designated by reference number 400, and a vacuum box, generally designated by reference number 500, according to an exemplary embodiment of the present invention, operating on a belt 600, which may be, for example, a structuring fabric or reel belt. As shown, the shower head 400 has a width that is less than that of the belt 600. The shower head 400 reciprocates across the width of the belt 600 along a first rail or beam 410. The vacuum box 500 also reciprocates across the width of the belt 600 along a second rail or beam 510. Movement of the shower head 400 and the vacuum box 500 may be controlled such that they are positioned directly opposite one another as they traverse across the belt.

The shower head 400 and vacuum box 500 may be suspended from a carriage or rail. As the traversing range of the shower head 400 and vacuum box 500 may not be coextensive with the width of the fabric being cleaned, it may be useful to utilize multiple shower heads and vacuum boxes that are staggered, thereby enabling cleaning of the full width of the fabric. Each set of shower heads and vacuum boxes may be suspended from separate carriages.

For enhanced fabric cleaning and/or drying, the inventions taught in co-pending U.S. patent application Ser. Nos. 17/336,694 and 17/474,556, and U.S. Provisional Application Nos. 63/257,184, 63/287,139 and 63/270,113, which are hereby incorporated by reference in their entirety, may be combined with the present invention.

Now that embodiments of the present invention have been shown and described in detail, various modifications and improvements thereon can become readily apparent to those skilled in the art. Accordingly, the exemplary embodiments of the present invention, as set forth above, are intended to be illustrative, not limiting. The spirit and scope of the present invention is to be construed broadly.

The invention claimed is:

1. A system for cleaning a through air drying fabric of a through air drying papermaking machine, comprising:

a high pressure shower configured to traverse across a width of the through air drying fabric at a through air drying section of the papermaking machine while ejecting water onto the through air drying fabric, the high pressure shower having a full width that is less than a full width of the through air drying fabric; and a vacuum box operatively connected to the high pressure shower, the through air drying section comprising a through air drying drum on which the through air drying fabric is mounted, and the high pressure shower and the vacuum box are configured to operate to clean the through air drying fabric while the through air drying drum is in operation.

2. The system of claim 1, wherein the high pressure shower is configured to eject water onto a sheet-contacting side of the through air drying fabric.

3. The system of claim 1, wherein the high pressure shower is configured to eject water onto a non-sheet-contacting side of the through air drying fabric.

4. The system of claim 3, further comprising a second high pressure shower configured to traverse across the width of the through air drying fabric of the papermaking machine while ejecting water onto a sheet-contacting side of the through air drying fabric, the second high pressure shower having a full width that is less than a full width of the through air drying fabric; and a second vacuum box operatively connected to the second high pressure shower.

5. The system of claim 1, wherein the through air drying fabric is a structuring fabric.

6. The system of claim 1, wherein the high pressure shower is positioned adjacent a machine roll upon which the through air drying fabric is wrapped 30° to 270° around a circumference of the machine roll.

7. The system of claim 1, wherein the vacuum box has a curved shape corresponding to the circumference of the machine roll.

8. The system of claim 1, wherein the high pressure shower is a needle shower.

9. The system of claim 1, wherein the needle shower comprises a plurality of nozzles.

10. The system of claim 9, wherein the plurality of nozzles are configured to eject round water jets with a diameter of 0.15 mm to 0.55 mm.

11. The system of claim 9, wherein the plurality of nozzles are configured to eject round water jets with a diameter of 0.2 mm to 0.3 mm in diameter.

12. The system of claim 9, wherein pressure of the water jets is 20 Bar to 600 Bar.

13. The system of claim 9, wherein pressure of the water jets is 100 Bar to 300 Bar.

14. The system of claim 9, wherein the needle shower comprises 1 to 50 nozzles.

15. The system of claim 9, wherein the needle shower comprises 1 to 20 nozzles.

16. The system of claim 9, wherein the needle shower comprises 1 to 10 nozzles.

17. The system of claim 1, further comprising an air knife configured to traverse across the width of the through air drying fabric of the papermaking machine while blowing air onto the through air drying fabric in a direction towards the vacuum box.

18. The system of claim 1, wherein the through air drying fabric comprises a multi-layer structured tissue fabric without direct channels extending perpendicularly through the fabric.

19. The system of claim 1, wherein the system comprises a sheet side and rolls side multi-unit traversing system that cleans each side separately.

20. The system of claim 1, wherein the through air drying fabric is a structured tissue fabric with air flow permeability between 250 to 500 cfm.

21. The system of claim 1, wherein the high pressure shower is a non-rotating pressure shower.

* * * * *